United States Patent [19]

Butler

[11] Patent Number: 5,022,305

[45] Date of Patent: Jun. 11, 1991

[54] TUBE OVERDRIVE PEDAL OPERABLE USING LOW VOLTAGE DC BATTERY ELMINATOR

[76] Inventor: Brent K. Butler, 1050 S. Lewiston Way, Aurora, Colo. 80017

[21] Appl. No.: 340,858

[22] Filed: Apr. 20, 1989

[51] Int. Cl.[5] ..... G10H 1/32; G10H 1/46

[52] U.S. Cl. ..... 84/711; 84/721; 84/741; 84/746; 330/51; 330/123; 381/61; 381/118

[58] Field of Search ..... 84/721, 735-741, 84/692-711, 746, 674, 677, 680; 328/162, 163; 330/144, 149, 51, 118-123; 381/61-65, 118

[56] References Cited

U.S. PATENT DOCUMENTS

| | | | |
|---|---|---|---|
| 2,577,753 | 12/1951 | Hanert | 84/721 X |
| 3,075,423 | 1/1963 | Brand et al. | 84/721 X |
| 3,078,753 | 2/1963 | Gibbs et al. | 84/721 X |
| 3,109,047 | 10/1963 | Clark | 84/721 X |
| 3,973,461 | 8/1976 | Jahns | 84/701 |
| 4,636,740 | 1/1987 | Kager | 84/674 X |
| 4,672,671 | 6/1987 | Kennedy | 381/61 |
| 4,701,957 | 10/1987 | Smith | 381/61 |

*Primary Examiner*—Stanley J. Witkowski

*Attorney, Agent, or Firm*—Harness, Dickey & Pierce

[57] ABSTRACT

The distortion pedal for electric guitar and other electronic musical instruments employs vacuum tube circuitry operated by low voltage "battery eliminator" DC power supply. A pull-up resistor biasing circuit on the vacuum tube grid improves input and output impedance and circuit headroom while providing good control over the harmonic content and sustain.

24 Claims, 3 Drawing Sheets

FIG - 1
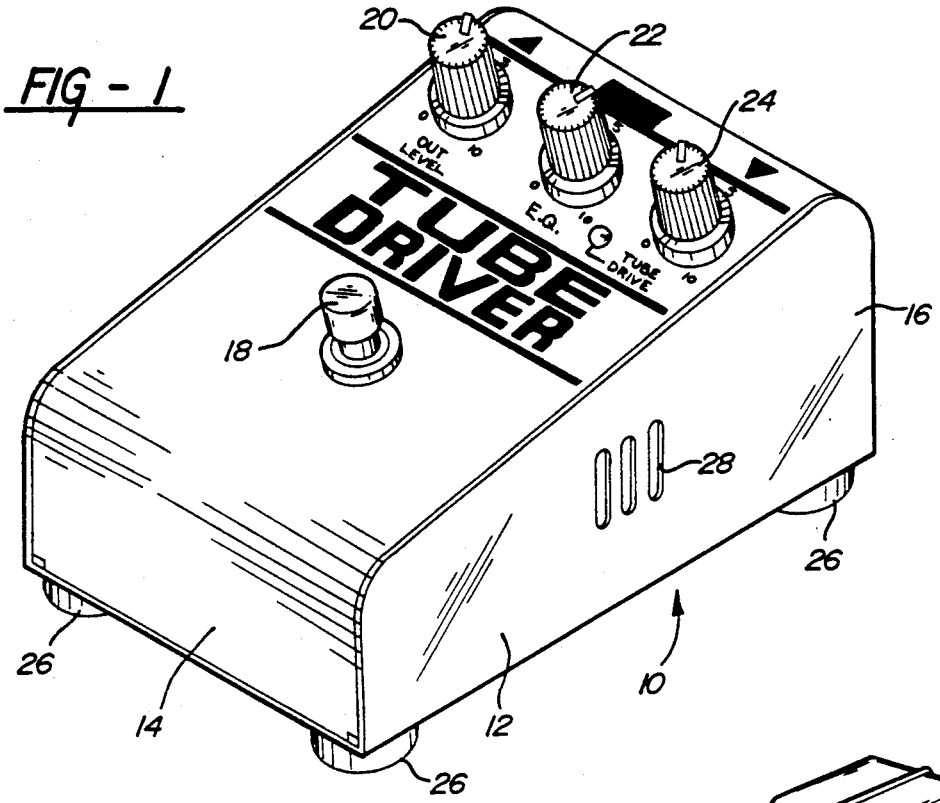
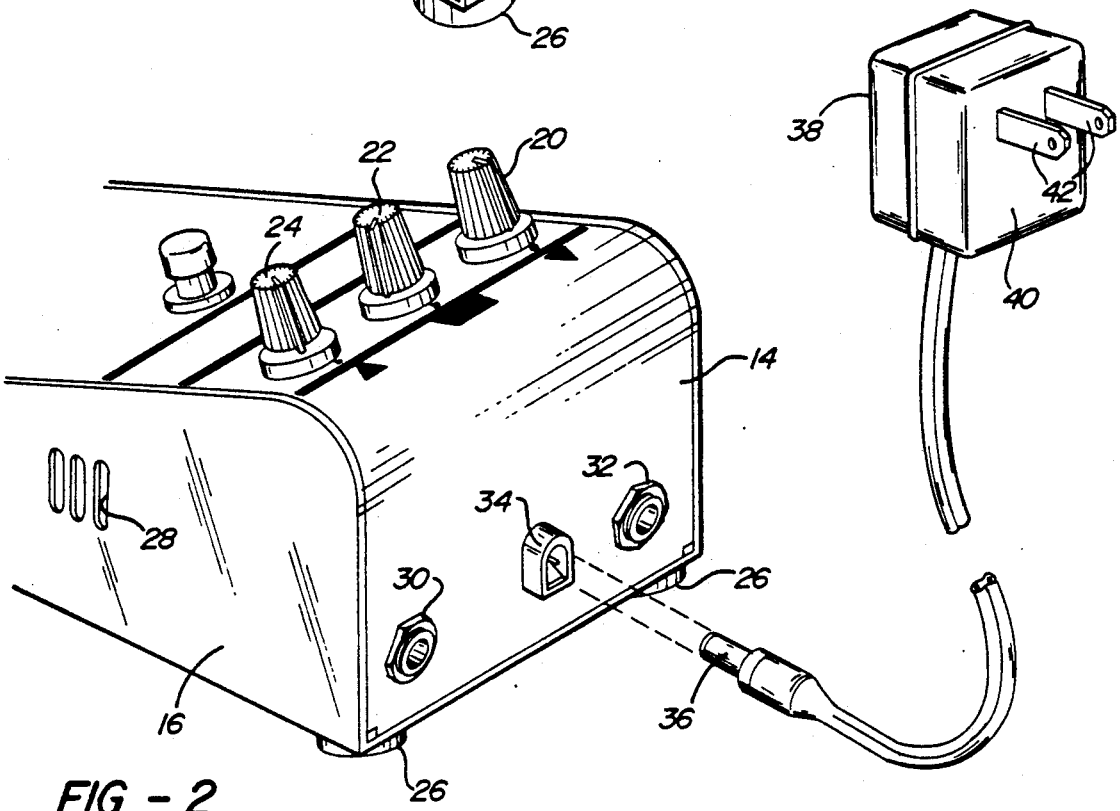
FIG - 2

LED
3.2V
2.2K
220Ω
220Ω
470/16V
220/16V
22K
22K
2.2uF
TUBE FIL. HEATERS
IN4001
1/2 4558
500K-A
120p
68K
1.5K
3.3K
124X7A
470K
100K
10K-B
100-K-A
.047
.01
2.2K
2.2uF
1K
1M
27P
INPUT
OUTPUT
DP DT FOOT SWITCH

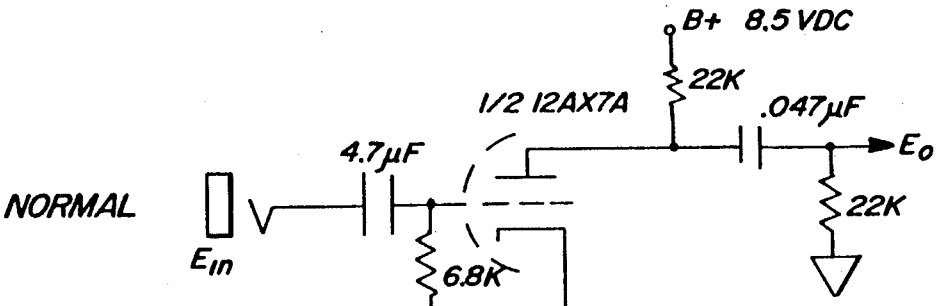
FIG - 4A
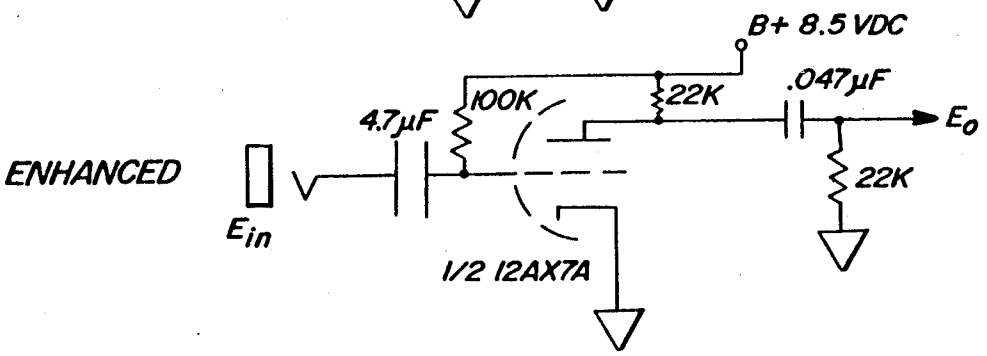
FIG - 4B
FIG - 4C
| CIRCUIT TYPE | INPUT Z | OUTPUT Z | INPUT E 1KHz | OUTPUT E | WAVEFORM |
|---|---|---|---|---|---|
| NORMAL | 6.8 KΩ | 22 KΩ | 0.3v RMS | 0.7v RMS W/ CLIPPING | |
| ENHANCED | 100 KΩ | 22 KΩ | 0.3v RMS | 1.2v RMS W/O CLIPPING | |

TUBE OVERDRIVE PEDAL OPERABLE USING LOW VOLTAGE DC BATTERY ELMINATOR

BACKGROUND AND SUMMARY OF THE INVENTION

The present invention relates generally to electronic musical instruments. More particularly, the invention relates to a signal processing device for altering the spectral content and sustain characteristics of electronic musical instruments such as electric guitars and the like.

The popularity of electric guitars and other electronic musical instruments has created quite a demand for signal processing devices to change the timber, overtones, coloration, sustain and other musical properties of the instrument. Today electronic musical instruments are played through amplifiers, audio mixing consoles and even portable headphone amplifiers. Regardless of the final output device, be it amplified speakers, mixing console or headphones, many musicians prefer using standalone signal processing devices to enhance their sound.

One type of signal processing device is the distortion booster which produces a fuzz-like tone by overdriving cascaded amplifier stages. There are many popular overdrive units on the market, many of them being transistorized battery-powered circuits housed in small foot pedal boxes. Occasionally, these transistorized distortion pedals have a jack for connection to an external "battery eliminator" power supply. These power supplies typically comprise a transformer and rectifier circuit in a self-contained module intended to be plugged directly into household AC current. Battery eliminators of this type typically supply either 6 or 9 volt DC output.

When several amplifier stages are cascaded together and biased to overdrive, nonlinearity results. Transistor circuits are used in foot pedal distortion booster circuits because they are economical and can be operated on low DC voltages. When driven into the nonlinear regime, transistor circuits tend to produce tonal harmonics which are odd multiples of the original or fundamental tone. This is what produces the distortion or fuzz-like sound. For some types of music, such sound is considered by some to be desirable.

However, many musicians find that the addition of odd harmonics to the fundamental tone lacks musical aesthetic qualities. It has been found that the even harmonics are more pleasing to many and would be preferred over the odd harmonics produced by transistor circuitry. Since naturally occurring musical tones and the scales and chords upon which modern music are based all employ even harmonics, it is advantageous to accentuate these harmonics by signal processing.

Although virtually replaced by transistor and semiconductor devices, vacuum tubes naturally provide the beneficial quality of generating even harmonics when overdriven to the point of distortion. There are some musical instrument amplifiers on the market today which use vacuum tube circuitry to gain this advantage. However, because of packaging and power supply constraints, there has not heretofore been a stand-alone distortion pedal operable by battery eliminator DC power supplies which use vacuum tubes. Indeed, the classical vacuum tube bias circuit often employs voltages in the range of ninety to several hundred volts for the plate supply, with 6 volt and 12 volt filament heater voltages being common. Thus traditional vacuum tube circuits simply are not designed to work with a 9 volt battery eliminator power supply of the type commonly used with transistorized distortion pedals. Of the very few distortion pedals which use vacuum tubes, all have 110 volt AC power cords like lamps, toasters and other household appliances.

Several problems arise when AC power is used in this conventional fashion. First, distortion pedals employing conventional AC power cords require step down transformers and rectification circuitry to be built into the foot pedal housing. Placement of the transformer in close proximity to the vacuum tube creates a significant problem with electromagnetically induced hum, an extremely undesirable quality in the musical instrument industry. In addition, because these devices operate at full line current, the components are more expensive and require Underwriter's Laboratories' approval. As a result, AC powered distortion pedals tend to cost approximately twice what the transistorized pedal costs.

Furthermore, the requirement of needing a separate AC outlet to operate a distortion pedal can be a significant drawback to the studio musician or performing musician. In the studio and on stage, there is often a shortage of AC outlets and also often quite a tangle of cables and wires leading between the instruments, microphones, amplifiers, mixing consoles and the like. The proximity of AC power cords to high impedance, high gain circuitry found in this equipment can induce unwanted hum. Also the AC power cord of a distortion pedal can create ground loop problems as well.

The present invention provides a unique and novel vacuum tube overdrive distortion pedal which is capable of operating from a low voltage "battery eliminator" DC power supply. The presently preferred embodiment employs a 12 AX7A vacuum tube (filament heater requirement 12 volts) and a 9 volt DC battery eliminator serves as the power supply. The invention provides a rich, warm distortion emphasizing even harmonics. The invention thus rivals the sound qualities of the finest AC powered tube distortion circuits, without any of the power supply problems described above.

The invention is preferably packaged in a small foot pedal with jack on the rear into which the conventional battery eliminator low voltage conductors are plugged. The foot pedal conforms to the size, shape and power requirements of popular transistorized effects devices. Thus the invention can be connected together with other effects devices to a common battery eliminator supply. There are effects pedal carrying cases on the market today which accommodate several interconnected effects pedals and which supply the pedals with the proper DC operating voltage. The distortion pedal of the invention will operate with such carrying cases, making it popular with traveling musicians.

The signal processing device of the invention employs a unique biasing circuit with pull-up circuitry which references the vacuum tube grid to the B+ supply voltage, rather than to ground as is the conventional practice. This gives the circuit a desirable high input impedance, increases nondistorted headroom substantially and lowers output impedance of the device. Although not fully understood, it is believed that the circuit also produces a secondary emission from the grid by pulling it slightly positive, allowing electrons from the cathode to move more freely toward the plate. Notably, the power supply voltage is also lower than the conventional requirements for filament heater operation.

For a more complete understanding of the invention, its objects and advantages, reference may be had to the following specification and to the accompanying drawings.

BRIEF DESCRIPTION OF THE DRAWINGS

FIG. 1 is a perspective view of the presently preferred embodiment of distortion pedal in accordance with the invention;

FIG. 2 is a rear perspective view illustrating the battery eliminator DC power supply;

FIGS. 4A-4C illustrate some of the advantages of the pull-up resistor bias circuit.

DESCRIPTION OF THE PREFERRED EMBODIMENT

Figure 3:
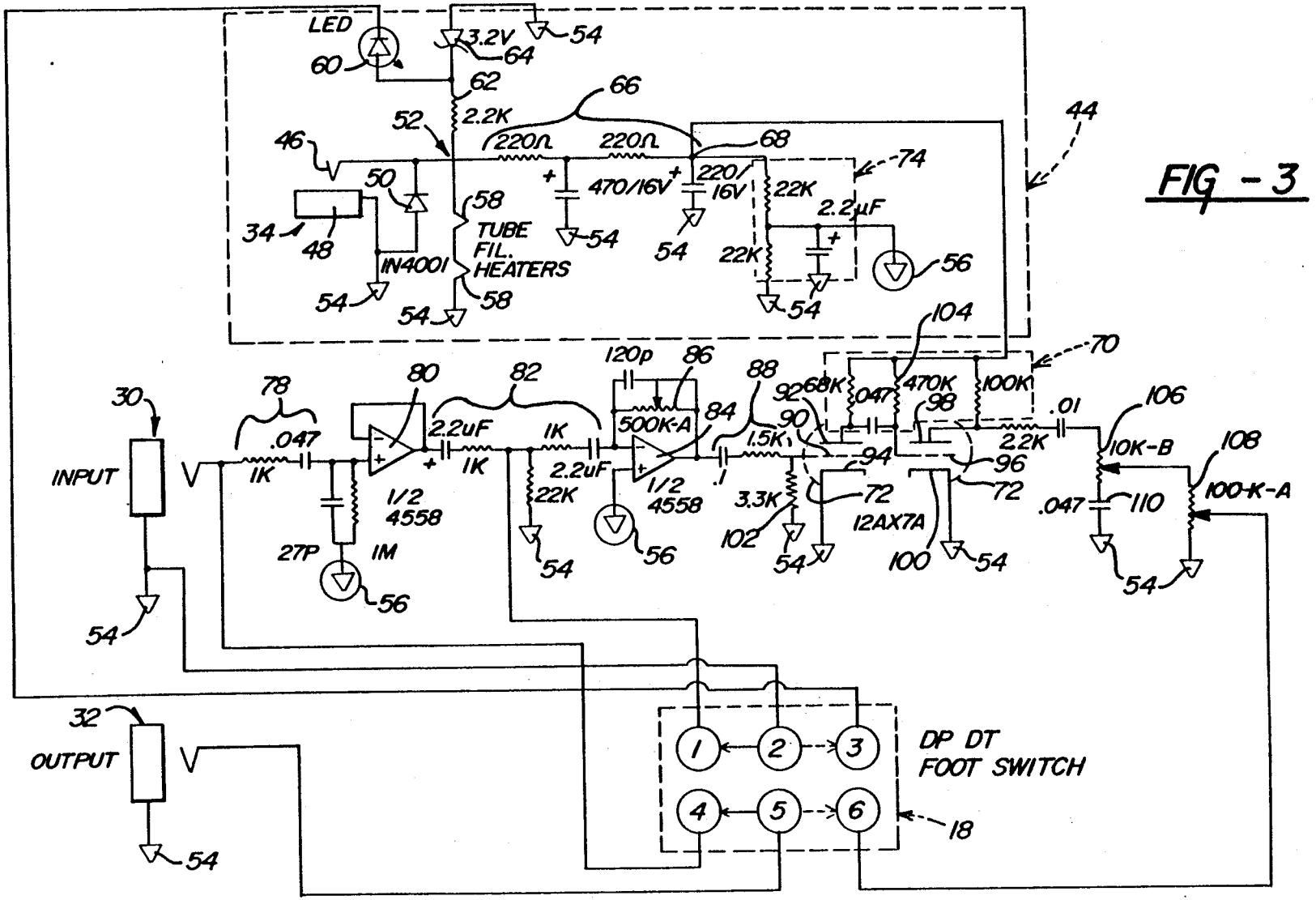
FIG. 3 is a schematic diagram of the presently preferred embodiment.

Referring to FIG. 1, the distortion pedal of the invention is illustrated generally at 10. The pedal is disposed in a metal housing 12 which preferably comprises a pair of interfitting generally U-shaped upper and lower components 14 and 16. The upper component defines an inclined top face on which a foot actuated push button 18 is mounted. Also mounted on the upper component of the housing are the output level adjustment knob 20, the equalization adjustment knob 22 and the overdrive adjustment knob 24. Preferably the lower component 16 includes nonskid rubber feet 26 and air vent louvers 28.

Referring to FIG. 2, the rear of upper component 14 has an input port 30 and an output port 32. Preferably the input and output ports are female phone jacks to accommodate the standard electric guitar cord. In use, a shielded cable is connected between input port 30 and the electronic instrument and a second cable is connected between output port 32 and the input of the musical instrument amplifier, mixing console or the like. Some musical instrument amplifiers and mixing consoles have provision for an effect loop comprising an effect send output and an effect receive input. Regardless of the specific method of connection, the input and output ports 30 and 32 are used to place the distortion pedal circuitry, yet to be discussed, in the audio signal path.

A DC power jack 34 is provided at the rear of housing 12 preferably generally between the input and output ports. This jack is adapted to receive the conventional plug 36 of a low voltage DC "battery eliminator" power supply 38. As illustrated, power supply 38 is housed in a self-contained case 40 which includes a pair of prongs 42 which plug directly into the AC house current. The presently preferred embodiment uses a 9 volt DC battery eliminator of conventional construction. Housed within case 40 is a step down transformer and rectifier circuit of conventional design.

Referring now to FIG. 3, the electronic circuit of the presently preferred embodiment is illustrated. The foot switch push button, comprising a double pole, double throw switch is illustrated at 18. Input port 30 and output port 32 are also illustrated as is DC power jack 34.

Referring first to the power supply conditioning section illustrated generally at 44, DC power jack 34 comprises a ring or sleeve 46 and a tip 48. Ring or sleeve 46 is connected to the positive side of the 9 volt DC supply, while tip 48 is connected to the negative side. Diode 50, which may be a IN4001, is connected between tip and ring with a polarity serving to short the tip and ring in the event the positive and negative power supply leads are incorrectly connected at a reverse polarity. This prevents damage to the circuitry. The negative side of the power supply, as at tip 48 is connected to circuit ground 54. For convenience, circuit ground is schematically illustrated by an inverted triangle symbol which is to be distinguished from the encircled inverted triangle symbol comprising the floating reference 56.

At node 52 of the power supply conditioning section 44, the vacuum tube filament heaters 58 are connected. Node 52 is nominally at 9 volts DC. Also connected at node 52 is a light-emitting diode 60 which receives power from a voltage divider circuit comprising resistor 62 and zener diode 64 which limits swing in voltage from pull-up resistor 62 to reduce audible pop which may be induced in the audio circuit. The light-emitting diode 60 is switched on and off by connection to terminal 3 of push button foot switch 18. As illustrated, this foot switch selectively makes and breaks contact between terminals 2 and 3, with terminal 2 being connected to circuit ground 54. The light-emitting diode 60 is used to indicate when the distortion circuit is engaged.

Following a resistor/capacitor power conditioning filtration stage 66, node 68 provides DC power to the remaining active electronic circuitry. Node 68 is nominally at 8.5 volts. Node 68 is connected directly through biasing resistors 70 to vacuum tube 72. The additional filtration and voltage divider stage 74 is used to further condition the DC voltage and to provide the floating reference 56 denoted by the encircled inverted triangle symbol. The operational amplifiers are powered by connecting the positive and negative supply terminals to node 68 and ground 54 respectively. The floating reference 56 is used to bias the input signal at the midpoint (approximately 4.2 volts) between the 8.5 volt and 0 volt supply rails.

Referring now to input port 30, the input signal is coupled through input impedance network 78 to a semiconductor operational amplifier 80 which is configured as a unity gain buffer to increase the input impedance of the circuit. The output of operational amplifier 80 is coupled through a resistive/capacitive impedance network 82 to a second semiconductor operational amplifier 84 which is configured as a preamplifier stage capable of overdriving vacuum tube 72. Operational amplifier 84 includes a potentiometer 86 in its feedback loop. Potentiometer 86 is connected to the overdrive adjustment knob 24 and is used to adjust the gain of operational amplifier 84.

The output of operational amplifier 84 is resistively and capacitively coupled through impedance network 88 to the grid 90 of vacuum tube 72. Vacuum tube 72 is preferably a 12AX7A vacuum tube device, which is a pair of triodes in a single package. As illustrated, these triodes are cascaded together in series, with the plate 92 of the first stage being connected to the grid 96 of the second stage. The cathodes 94 and 100 of both vacuum tube stages are connected to circuit ground 54. The plates 92 and 98 are both biased by the positive node 68 which may be considered as the B+. Grid 90 of the first stage is biased toward ground through pull-down resistor 102. Notably, grid 96 of the second stage is biased toward the B+through pullup resistor 104. The output of vacuum tube 72 on plate 98 is resistively and capacitively coupled through equalization potentiometer 106 and output level potentiometer 108. As illustrated, the equalization potentiometer includes a capacitor 110 permitting this potentiometer to serve as a variable high pass filter in the nature of a treble cut tone control. Potentiometer 106 is operated by the equalization adjustment knob 22 which potentiometer 108 is operated by the output level adjustment knob 20.

The output of potentiometer 108 is connected to terminal 6 of the foot switch push button 18. As illustrated, terminal 5 of push button 18 may be selectively connected to terminal 6 which connects the output of potentiometer 108 to the output port 32. In the opposite position, push button 18 connects the input port 30, via terminal 4, to the output port 32. In this position, the distortion circuitry is bypassed and the input signal is fed directly to the output port.

Push button 18 is configured so that when terminals 4 and 5 are connected together, directly coupling input port 30 with output port 32, terminals 2 and 3 are also connected together. This effectively grounds node 112, preventing an input signal from entering the preamplifier and vacuum tube stages. When the switch 18 is in the opposite position, the direct connection between input and output ports is broken and the output port 32 is instead fed with a modified (distorted) signal from potentiometer 108 by the connection of switch terminals 5 and 6. Switch terminals 1 and 2 are also connected in this position, permitting power to flow through light-emitting diode 60. Light-emitting diode 60 is visible on the front panel of the upper housing component 14. Illumination of this diode indicates that the distortion circuitry is engaged.

From the foregoing it is seen that the present invention is able to operate a vacuum tube circuit employing a 12AX7A vacuum tube device. This device normally requires a 12 volt heater current and considerably higher plate voltages to operate in conventional fashion. The present circuitry produces highly desirable and musical qualities not found in transistorized distortion pedals. The invention rivals more expensive AC powered vacuum tube distortion pedals, without the associated hum and ground loop problems found with such AC powered pedals.

While the reasons for these advantageous results are not fully understood, some of the benefits are believed to be attributable to the bias circuit in which the grid 96 of the second stage is biased towards B+ through pullup resistor 104. In contrast to the conventional practice of biasing the grid towards ground. To confirm this, an experiment was conducted in which the circuits of FIGS. 4A and 4B were compared and the results recorded in the chart of FIG. 4C. Comparing the circuits of FIGS. 4A and 4B, it is seen that the principal difference is that in FIG. 4A the grid is biased through a 6.K resistor to ground, in conventional fashion. In FIG. 4B the grid is biased through a 100K resistor to the B+ rail. Referring to FIG. 4C, it is seen that the enhanced circuit of FIG. 4B provides a much higher input impedance, a desirable property in this application. The output impedance of both circuits remains substantially the same. For an input sinusoidal waveform of 0.3 volts RMS. the output of conventional or normal circuit of FIG. 4A produced a 0.7 volt RMS output with clipping. The enhanced circuit of FIG. 4B produced a 1.2 volt RMS output signal without clipping. Representative waveforms are illustrated in FIG. 4C.

The foregoing experiment demonstrates that the pullup resistor biasing of the grid has the benefit of producing a much higher input impedance, comparable output impedance and much improved nondistorted headroom. With increased headroom, the circuit can be driven in the nonlinear regime with more subtle control and at higher output levels, if desired. Increased headroom gives greater output which allows the equalization circuit to be implemented with lower impedance components. This reduces output impedance to thereby reduce output hum which can otherwise be induced by stray electromagnetic signals. Controlled distortion is provided over a wide range before serious, nonmusical clipping occurs. This results in a product with gives the musician a great deal of tonal control over the sound as well as very good control of sustain. These are highly desirable properties, sought by electric guitar players and other electronic musical instrument players.

While the invention has been described in connection with the presently preferred embodiment, the principles of the invention are capable of modification and change without departing from the spirit of the invention as set forth in the appended claims.

What is claimed is:

1. A signal processing device for electronic musical instruments comprising:

a signal processing circuit having a vacuum tube device having a filament heater, at least one plate, at least one cathode and at least one grid and being capable of operation in a nonlinear regime;

said signal processing circuit including bias circuit means coupled to said vacuum tube device for causing said vacuum tube device to operate in a nonlinear regime;

said signal processing circuit being disposed in a housing;

a direct current power supply means packaged separately from and external to said housing and coupled to said bias circuit means for supplying a single polarity DC voltage and a DC ground for operating said signal processing circuit;

said signal processing circuit having input port for coupling to said musical instrument and having an output port, whereby signals applied to said input port are processed nonlinearly by said signal processing circuit and provided to said output port;

said vacuum tube device being coupled to said power supply through said bias circuit whereby said cathode is referenced to said DC ground, said plate is referenced to said single polarity DC voltage and said filament heater is supplied by said DC voltage;

said bias circuit including pull up circuit coupled to said grid whereby said grid is referenced to said DC voltage.

2. The device of claim 1 further comprising foot actuable switching means disposed on said housing for controlling the operation of said signal processing circuit.

3. The device of claim 1 wherein said power supply means comprises a self-contained transformer and rectifier circuit for direct plug in connection to household alternating current.

4. The device of claim 1 wherein said vacuum tube device includes a filament heater circuit of predefined voltage requirement and wherein said single polarity DC voltage is lower than said predefined voltage.

5. The device of claim 1 wherein said single polarity DC voltage is below 48 volts DC.

6. The device of claim 1 wherein said single polarity DC voltage is below 24 volts DC.

7. The device of claim 1 wherein said single polarity DC voltage is below 12 volts DC.

8. The device of claim 1 wherein said single polarity DC voltage is nominally 9 volts DC.

9. The device of claim 1 wherein said single polarity DC voltage is below 9 volts DC.

10. The device of claim 4 wherein said predefined filament heater voltage is 12 volts and said power single polarity DC voltage is nominally 9 volts DC.

11. The device of claim 1 wherein said power supply means defines a positive B+ voltage and a ground and wherein said vacuum tube device has a grid, a cathode and a plate and wherein said bias circuit includes a means for referencing said cathode to ground, a means for referencing said plate to B+ and a pull up circuit for referencing said grid to B+.

12. The device of claim 1 wherein said signal processing circuit includes signal switching means coupled between said input port and said output port for selectively coupling said signal applied to said input port directly to said output port, thereby bypassing the nonlinear processing by said vacuum tube device.

13. The device of claim 12 wherein said signal switching means includes a foot actuable switch disposed on said housing.

14. The device of claim 1 wherein said signal processing circuit includes adjustable gain preamplifier means coupled to said vacuum tube device for altering the degree of nonlinearity of said signal processing circuit.

15. The device of claim 1 wherein said signal processing circuit includes adjustable output level control means coupled to said output port for altering the amplitude of the signal provided to said output port.

16. The device of claim 1 wherein said signal processing circuit includes tone control circuit for altering the frequency content of the signal provided to said output port.

17. In an electrical musical instrument sound modification device comprising:

a case having a footpedal disposed thereon;

an electronic signal modification circuit disposed in said case and operably coupled to said footpedal;

said electronic signal modification circuit comprising at least one vacuum tube device having a biasing circuit coupled thereto;

said biasing circuit being coupled to a jack disposed on said case;

a DC power supply disposed in a package separate from said case and having a plug for detachable insertion in said jack for supplying DC power to said biasing circuit;

said vacuum tube device having a filament heater for operating said filament a predetermined heater voltage and wherein said DC power supply delivers current to said biasing means at a voltage not substantially greater than said predetermined heater voltage.

18. The device of claim 17 wherein said biasing circuit is transformerless.

19. The device of claim 17 wherein said DC power supply has at least two AC current prongs adapted to be plugged directly into a source of AC line current.

20. The device of claim 17 wherein said DC power supply delivers current to said biasing means at a voltage substantially less than ninety (90) volts.

21. The device of claim 17 wherein said DC power supply delivers current to said biasing means at a voltage substantially less than thirty-six (36) volts.

22. The device of claim 17 wherein said DC power supply delivers current to said biasing means at a voltage substantially less than twenty-four (24) volts.

23. The device of claim 17 wherein said DC power supply delivers current to said biasing means at a voltage substantially less than twelve (12) volts.

24. The device of claim 17 wherein said DC power supply delivers current to said biasing means at a voltage substantially equal to nine (9) volts.

* * * * *

UNITED STATES PATENT AND TRADEMARK OFFICE

CERTIFICATE OF CORRECTION

PATENT NO. : 5,022,305

DATED : June 11, 1991

INVENTOR(S) : Brent K. Butler

It is certified that error appears in the above-identified patent and that said Letters Patent is hereby corrected as shown below:

Col. 3, line 65, after "comprises a" delete "ring or sleeve 46 and a tip 48." and insert therefore--tip 46 and a ring or sleeve 48.--

Col. 4, line 3, after "incorrectly" delete "connected"

Col. 6, line 12, delete "with" and insert therefor --which--.

Signed and Sealed this

Sixth Day of April, 1993

*Attest:*

STEPHEN G. KUNIN

*Attesting Officer*

*Acting Commissioner of Patents and Trademarks*